United States Patent [19]

Fader et al.

[11] Patent Number: 4,768,388

[45] Date of Patent: Sep. 6, 1988

[54] PREEXISTING TORQUE MEASURING DEVICE FOR THREADED FASTENERS

[76] Inventors: Hugh Fader, 1069 Larkmoor Blvd., Berkley, Mich. 48072; Ralph S. Shoberg, 6176 Briggs Lake Dr., Brighton, Mich. 48116

[21] Appl. No.: 31,325

[22] Filed: Mar. 27, 1987

[51] Int. Cl.[4] ..... B25B 23/142

[52] U.S. Cl. ..... 73/862.23; 73/761; 364/508

[58] Field of Search ..... 73/761, 862.23, 862.24; 364/508

[56] References Cited

U.S. PATENT DOCUMENTS 4,450,727 5/1984 Reinholm et al. ..... 73/862.23

*Primary Examiner*—Charles A. Ruehl

*Attorney, Agent, or Firm*—Krass & Young

[57] ABSTRACT

A method and apparatus for accurately determining the previously applied torque to a threaded fastener. Torque is increasingly applied to the fastener and measured periodically. The measurements are digitized and stored in a microprocessor. The torque previously applied is the torque that causes the fastener to breakaway or start to begin to turn. This breakaway point is the torque corresponding to a change in the slope of the applied torque-time relationship. The breakaway point is determined by determining the maximum different value between the measured torque and a mathematical line segment commencing from below the breakaway point and extending to the peak torque applied. The breakaway point (or applied torque) is the torque corresponding to the calculated maximum difference value.

12 Claims, 9 Drawing Sheets

PREEXISTING TORQUE MEASURING DEVICE FOR THREADED FASTENERS

FIELD OF THE INVENTION

The field of the present invention is the measurement of the torque previously applied to a threaded fastener by retorquing the fastener.

BACKGROUND OF THE INVENTION

It is the object of the present invention to measure the torque previously applied to a threaded fastener by retorquing the fastener and measuring the resulting applied torque. It has been previously proposed in the art to retorque such a threaded fastener and determine the breakaway torque. This breakaway torque is the torque at which the threaded fastener is no longer static but begins to move. This breakaway torque is a good approximation of the torque previously applied to the threaded fastener. This determination has been previously made by applying increasing torque to the threaded fastener until some torque greater than this breakaway torque is achieved. The problem with this proposal in accordance with the prior art is that prior techniques for determining the breakaway torque are insufficiently accurate and insufficiently robust in the presence of differing environments. Thus, it would be highly advantageous to provide a retorque meter which provides an accurate and stable detection of the breakaway torque.

SUMMARY OF THE INVENTION

The present invention provides a method and apparatus for accurately determining the previously applied torque to a threaded fastener without significantly changing the applied torque on the fastener. The invention involves a unique combination of steps to determine the breakaway torque upon retorquing the fastener. This breakaway torque provides an excellent estimate of the previously applied torque. The measuring method is comprised of the following steps: (a) applying torque to the threaded fastener in the tightening direction in gradually increasing magnitude until a decrease in the slope of the torque/time curve is reached indicating slight rotation of the threaded fastener in the tightening direction; (b) simutaneously measuring and storing the applied torque at repetitive predetermined time intervals; (c) determining the stored peak torque; (d) determining the time interval of the stored fractional torque which first exceeds a first predetermined fraction of the stored peak torque; (e) calculating the torque for each repetitive time interval from the time of the stored fractional torque to the time of the stored peak torque of a line segment joining the stored fractional torque and the stored peak torque; (f) calculating the difference value between the stored torque and the calculated torque line segment for each repetitive time interval between the time interval of the stored fractional torque and the stored peak torque; and (g) indicating the stored torque corresponding to the time interval of the greatest calculated difference value as the previously applied torque.

The apparatus includes a torque sensor coupled to a device to apply increasing torque to the fastener, a clock, memory means for storing measured torque values at predetermined time intervals, means for determining the stored peak torque, means for determining the torque corresponding to the line segment from a predetermined fraction of the peak to the peak at each predetermined time interval, means for determining and storing the difference between the measured torque and calculated torque line segment, means for determining the maximum difference value, and means for indicating the torque corresponding to the maximum difference value as the previously applied torque to the fastener.

DETAILED DESCRIPTION OF THE PREFERRED EMBODIMENT

Figure 1:
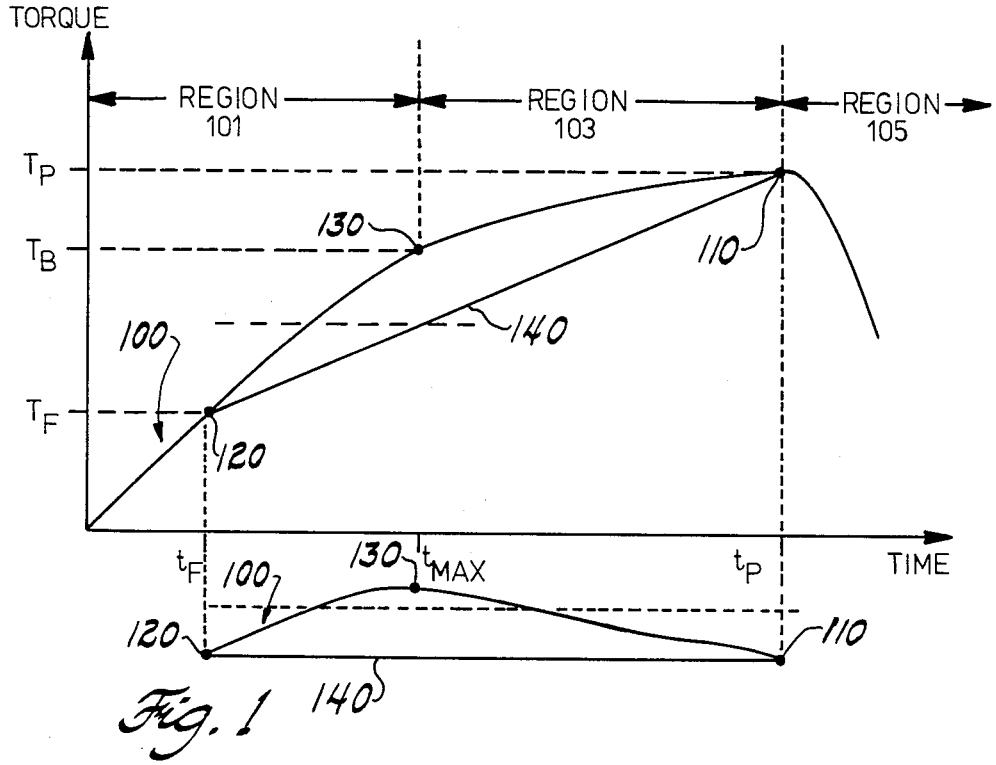
FIG. 1 is a graph of applied torque versus time for a fastener illustrating simple breakaway evident in most fasteners.

Referring now to the drawings, and more particularly to FIG. 1, there is shown curve 100 of increasing torque as applied to a typical threaded fastener over time. In region 101 the fastener is stationary and therefore the torque applied is less than that previously applied to the fastener. At the transition between regions 101 and 103, the fastener breaks away and begins to rotate as indicated by the decrease in the slope of the torque/time curve. When the operator feels the threaded fastener move, then he stops application of torque to the fastener. The torque thus increases to a peak at point 110 beyond the breakaway point 130 and begins to fall in region 105 as the applied torque is decreased. The breakaway point 130 marking the boundary between regions 101 and 103 is the most accurate estimate of the actual previously applied torque on the fastener. Therefore it is the object of this invention to detect and display the breakaway torque as the previously applied torque.

Figure 2:
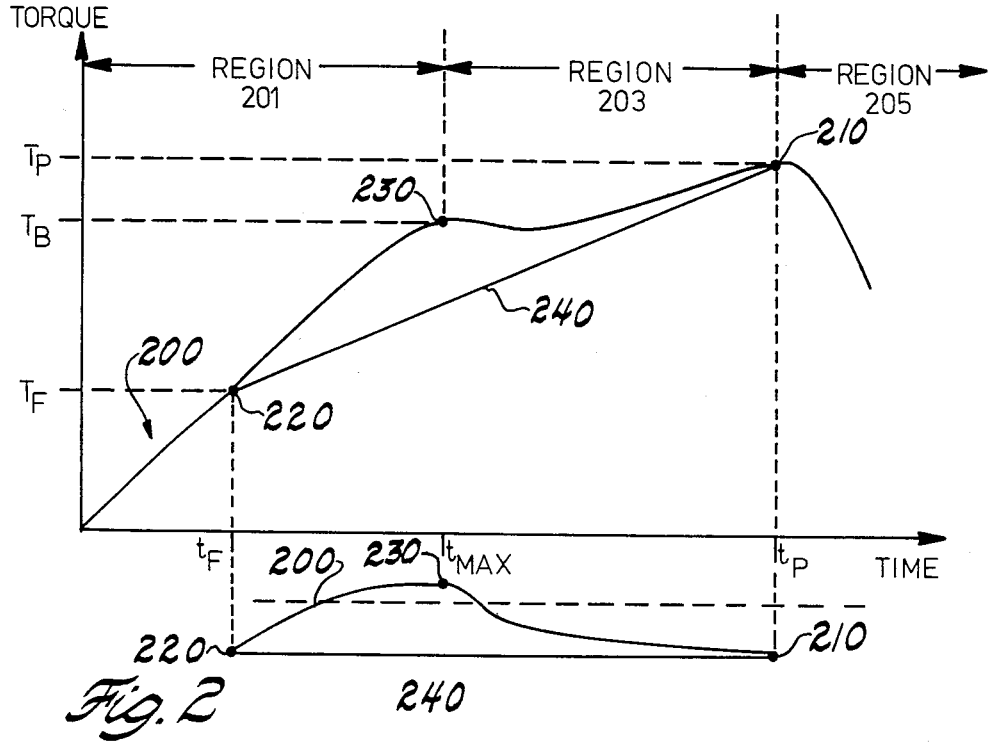
FIG. 2 is a graph of applied torque versus time for a fastener illustrating the pronounced breakaway change that occurs in some fasteners.

Referring now to FIG. 2, some fasteners do not exhibit a smooth shift at the breakaway point 230 between region 201 and region 203. FIG. 2 shows curve 200 similar to curve 100 illustrated in FIG. 1, but in FIG. 2 the slope of the applied torque changes direction in region 203. The torque can actually decrease before increasing again. Therefore it is a further object of this invention to accommodate this condition in the embodiment description that follows.

Figure 3:
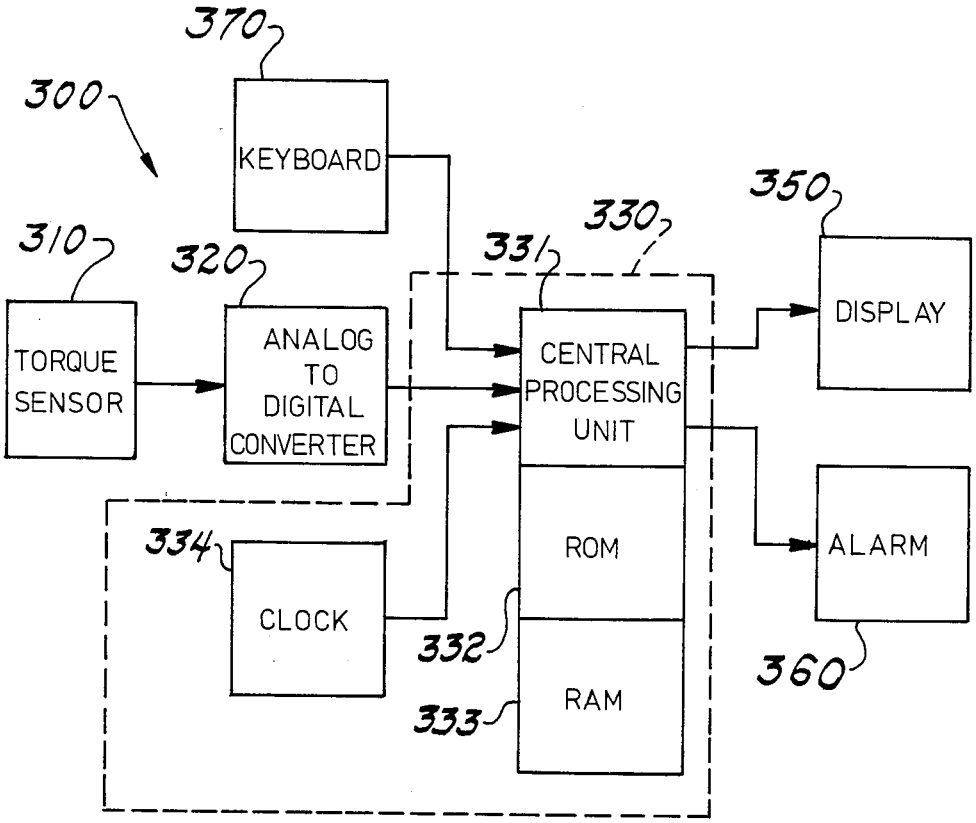
FIG. 3 is a block diagram of the electronic circuitry of the present invention.
Figure 4A:
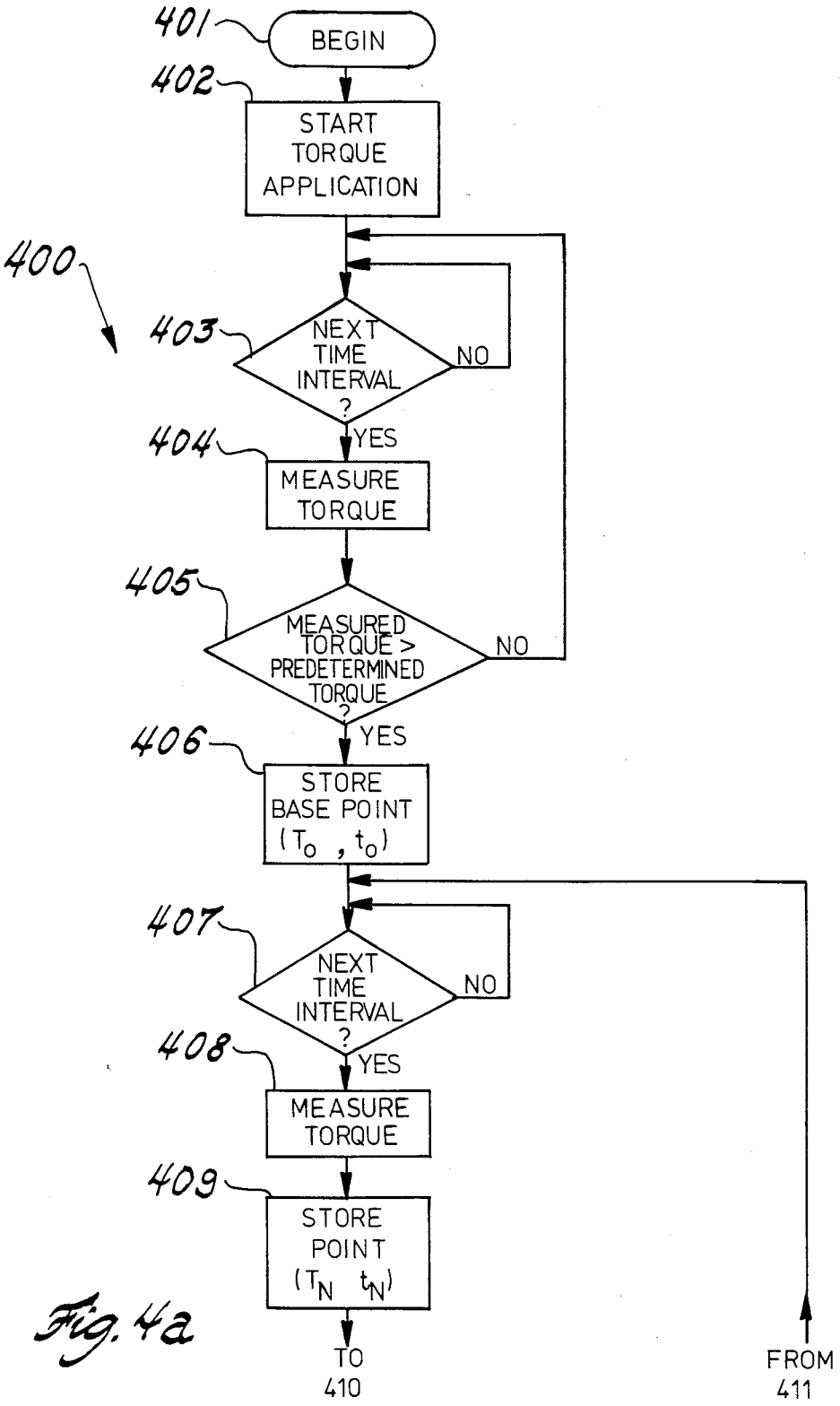
FIGS. 4*a* to 4*d* are a flow chart illustrating the measurement and calculational steps comprising the present invention.
Figure 4B:
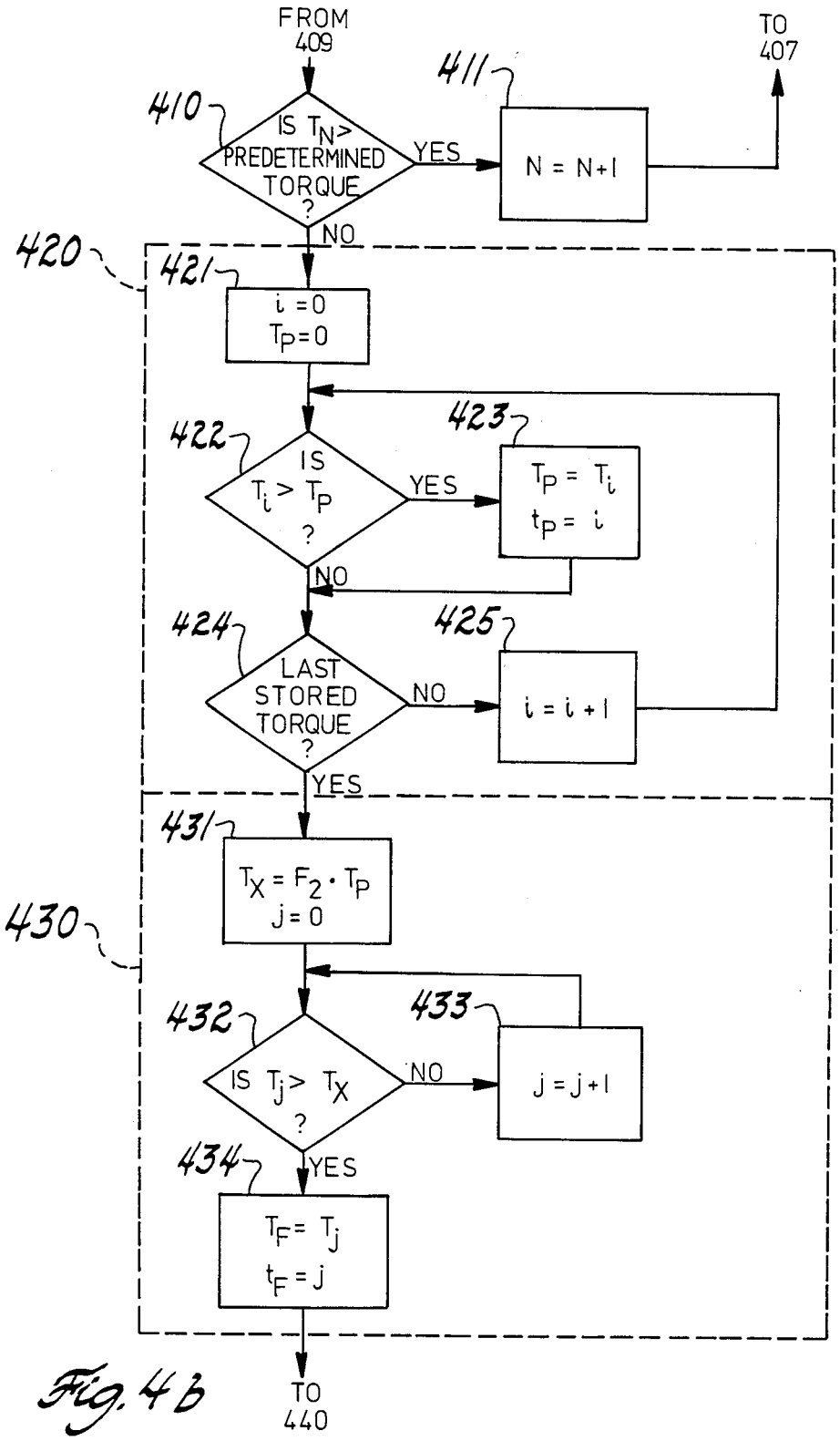
Figure 4C:
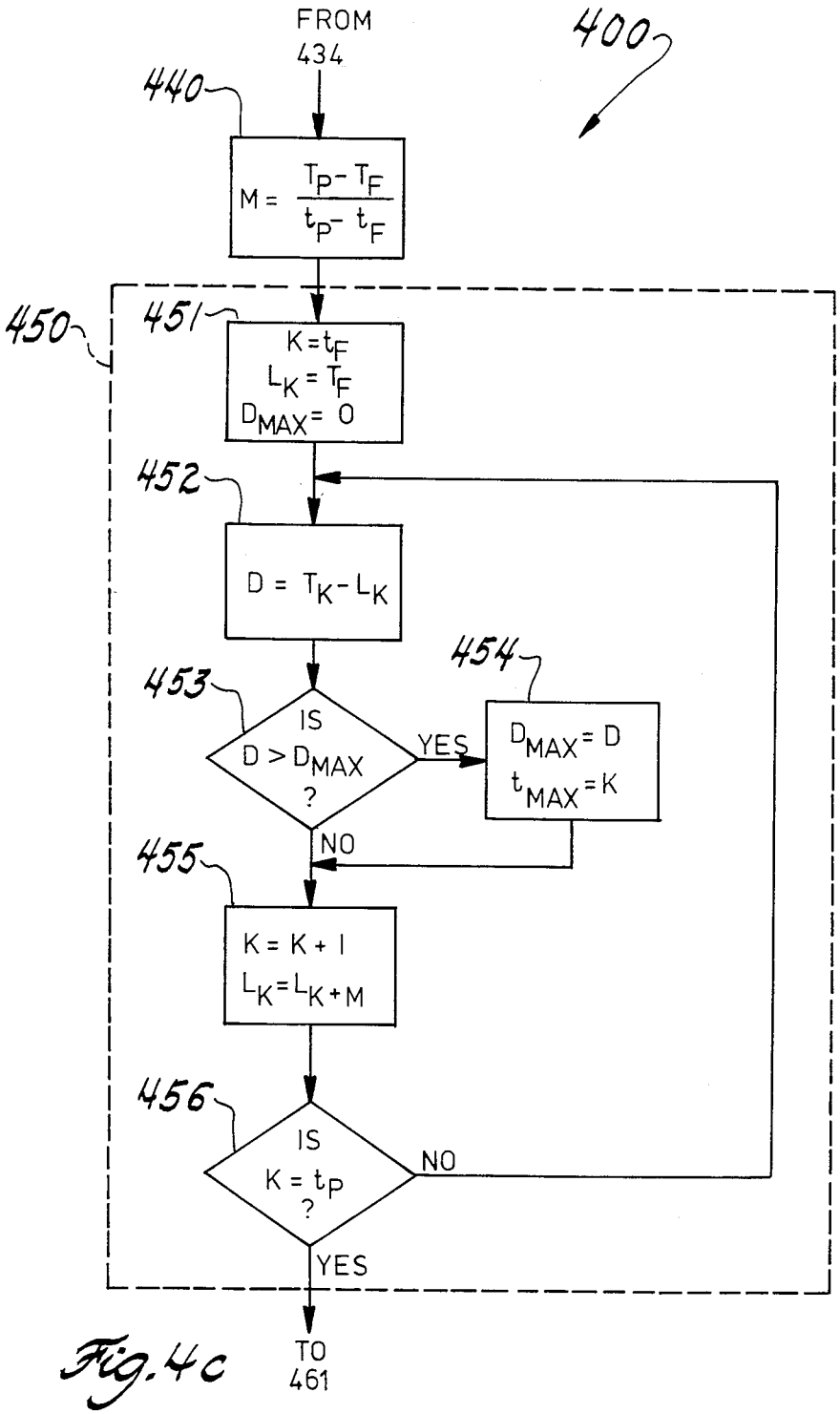
Figure 4D:
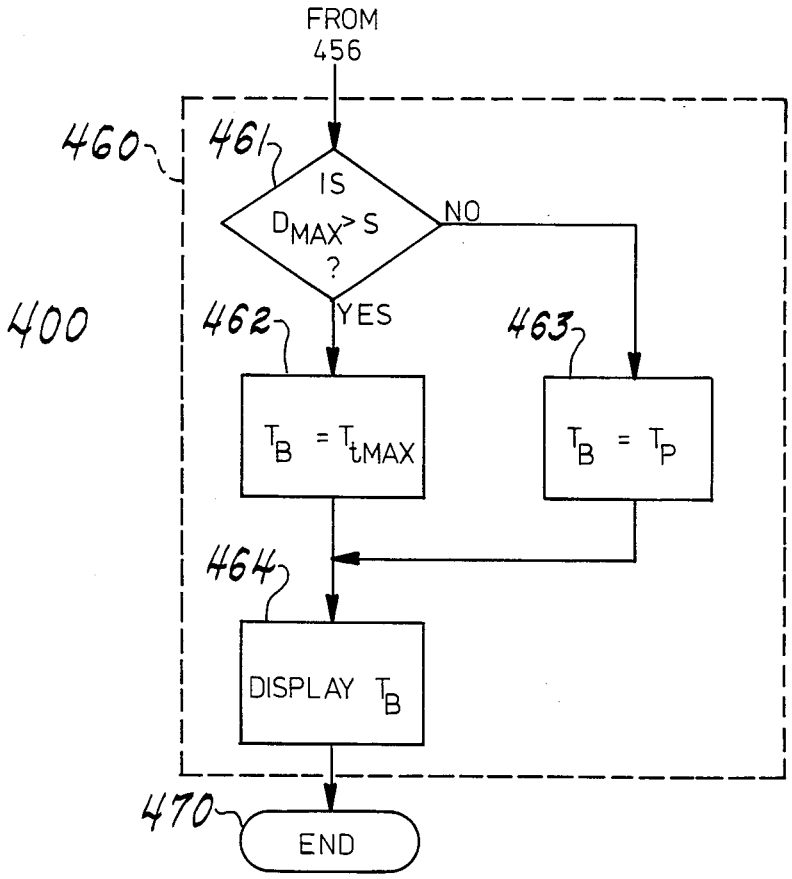

FIG. 3 shows a block diagram of an apparatus 300 according to the present invention to detect and display the previously applied torque on the fastener being tested. A torquing device including a torque sensor 310 is applied to the head of the fastener. The applied torque sensed by the torque sensor 310 is then digitized by analog to digital converter 320 and control unit 330.

Control unit 330 preferably is a microprocessor device including central processing unit 331, read only memory 332 and random access read/write memory 333 and clock 334. Clock 334 provides time marking signals to the central processing unit 331 for measuring time intervals. A keyboard 370 provides means to initialize the control unit 330 and to input various required parameters more fully described below. Apparatus 300 further includes a display 350 and an alarm unit 360.

Referring once again to FIG. 1, the breakaway point 130 is determined by first applying gradually increasing torque to the threaded fastener in the tightening direction and simultaneously sampling and storing the applied torque at predetermined periodic intervals. After the measured torque exceeds a predetermined value, control unit 330 begins storing the measured torque values. The control unit 330 tests each sampled value of torque to determine whether this torque is greater than the predetermined torque. If the current sample is less than the predetermined torque, then the peak torque has been passed. This predetermined torque is selected to permit any dip in the curve 200 as illustrated in FIG. 2. The measurement is thus complete and control unit 330 can begin the computation of the breakaway torque. Control unit 330 then determines the time interval $t_F$ of point 120 when the stored torque first exceeds a predetermined fraction of the peak torque, usually 40% of the peak torque. This predetermined fraction must be selected to insure that base point 120 has a torque below the anticipated breakaway torque. The control unit 330 next calculates the difference between the stored values corresponding to curve 100 and the line segment 140 in FIG. 1 or line segment 240 in FIG. 2. Control unit 330 then determines the time interval having the greatest calculated difference value. The greatest calculated difference value is then compared with a second predetermined value. This predetermined value is preferably approximately 2% of the instruments full scale torque. This predetermined value is a sensitivity setting. If the greatest calculated difference value is not greater than this predetermined value then the peak torque is displayed via display 350 as the previously applied torque. This peak torque is displayed as the best estimate of the previously applied torque because the operator has detected breakaway. If the greatest calculated difference value is greater than the predetermined value, then the torque corresponding to the time interval of the greatest calculated difference value is displayed as the previously applied torque.

FIGS. 4*a* to 4*d* together illustrate flow chart 400 which is a diagram of the program for control of the microprocessor embodying control unit 330. It should be understood that flow chart 400 is intended only to illustrate the general overall outlines of the program for control of the microprocessor. Those skilled in the art would understand how to convert this flow chart into the proper exact program for control of the microprocessor unit once the design choice for the microprocessor unit has been made.

Figure 5:
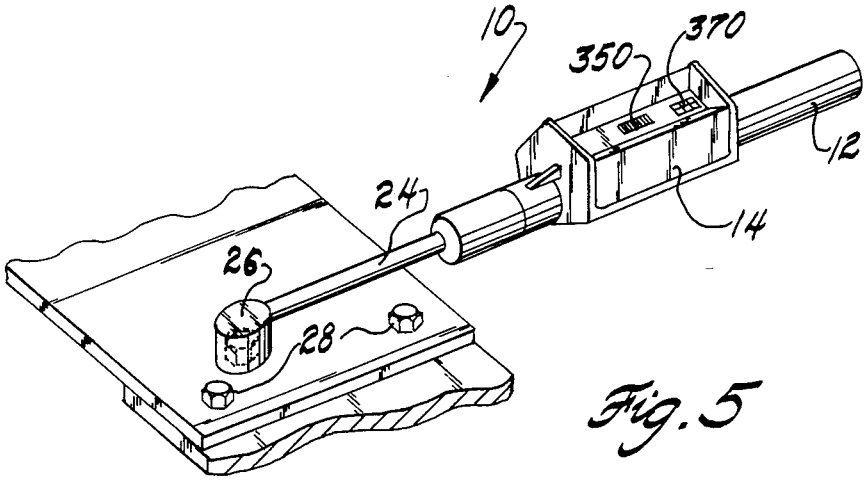
FIG. 5 is a perspective view of a hand-held tool which could be used to embody the present invention.

Program 400 is begun via begin block 401. Firstly, the application of the torque to the threaded fastener is begun (processing block 402). In accordance with the preferred embodiment of the present invention as illustrated in FIG. 5, the retorque meter is a handheld apparatus in which the torque is applied to the threaded fastener by hand. In this embodiment, processing block 402 indicates the apparatus is in the proper state for measuring and controlling the torque applied to the threaded fastener. In the event that the apparatus is constructed employing an automatic torque generator, then processing block 402 activates this automatic torque device. Program 400 next tests to determine whether the next predetermined time interval has passed (decision block 403). If this predetermined time interval has not passed then program 400 returns to decision block 403 to again test for the next time interval. Program 400 remains in this state until the next time interval has passed. The determination of whether or not the next time interval has passed is made by central processing unit 331 in conjunction with time signals received from clock 344. Program 400 next measures the torque applied to the threaded fastener. This torque is measured via torque sensor 310 and converted into a digital signal suitable for processing by central processing unit 331 via analog-to-digital convertor 320. Program 400 next tests to determine whether the measured torque is greater than a predetermined minimum torque (decision block 405). This predetermined minimum torque is generally set to approximately 10% of the expected peak torque. In the event that the measured torque is not greater than the predetermined minimum torque then program 400 returns to decision block 403 to await the passing of the next time interval. If this measured torque is greater than the predetermined minimum torque then program 400 stores a base point including the just measured base torque to and the base time interval to (processing block 406). This process ensures that the torque applied to threaded fastener reaches this minimum amount before the torque and time is stored in random access memory 333. Thus the amount of random access memory 333 required for this device is minimized.

Program 400 next enters a state in which successive torque and time intervals are detected and stored. Firstly, program 400 tests to determine whether or not the next time interval has passed (decision block 407). In the event the next time interval has not passed then program 400 again enters decision block 407 to test whether or not the next time interval has passed. Program 400 remains in this state awaiting the passage of the next time interval until this time interval has passed. At that time the torque is measured (processing block 408). As noted above this torque is measured via torque sensor 310 and converted into a digital form via analog-to-digital convertor 320. Next program 400 stores this just measured torque and time point including the current measured torque $T_N$ and the current measured time $t_N$ (processing block 409). As noted above these quantities are stored within random access memory 333 under the control of central processing unit 331.

Program 400 next tests to determine whether the current measured torque $T_N$ is greater than the predetermined torque (decision block 410). If this is the case, then the index variable N is incremented torque $T_N$ (processing block 411). Control of program 400 then returns to decision block 407 to await the next time interval. If, on the other hand, the current measured torque $T_N$ is not greater than the predetermined torque, this indicates the operator has detected breakaway and has decreased the applied torque (processing block 413). Thus the measurement is complete and control unit 330 can calculate the breakaway torque.

Program 400 next enters subroutine 420 which determines the peak torque value $T_p$ and the time interval $t_p$ at which this occurs. To simplify calculations, the difference between time intervals is assumed to be one.

This may be done since any regular interval will suffice. Processing block 421 first sets an index variable i and $T_p$ equal to 0. Decision block 422 tests to see if the stored torque at this point $T_i$ is greater than $T_p$. If so, processing block 423 sets $T_p$ to Ti and tp, the time of peak torque, to i. In either event, control is passed to decision block 424 which checks to see if the last of the stored torque values has been reached. If not, processing block 425 increments the index variable and passes control to decision block 422. This action proceeds until the end of the stored torque values is reached.

Program 400 next enters subroutine 430 which determines the torque value $T_f$, which first exceeds a predetermined percentage of the peak torque and the time $t_f$, at which this occurs. The process starts by calculating the value $T_x$ as the product of the peak torque and $F_2$, the percentage ($F_2$ is preferably set to 0.40) and by setting an index variable to 0 (processing block 431). It then tests to determine whether the stored torque $T_j$ is greater than the fraction of the peak torque (decision block 432). If not, processing block 433 increments the index variable and control is passed back to decision block 432 to continue the search. If so, the loop is exited and the fractional torque $T_f$ is set to the stored torque value at this point and the time $t_f$, is set to the value of index variable j.

Program 400 next enters processing block 440 which calculates m, the slope of the line connecting the stored peak torque $T_p$, and the torque which first exceeds a predetermined percentage of the torque $T_f$. This is done with a simple rise over run calculation.

Control is then passed to subroutine 450 which determines the point where the difference between the stored torque and the line segment is maximum. Processing block 451 initializes an indexing variable, K, to the time interval of the fractional torque $t_f$. It then sets the first value of the line equal to the fractional torque $T_f$. These two points define the left end point of the line. This block also initializes the maximum difference value to 0. Processing block 452 then calculates the difference, D, between the stored torque at time K and the line's value. Decision block 453 then tests to determine if this difference is greater than the maximum difference. If it is, $D_{max}$ is set to this value, and the time $t_{max}$ is set to K (processing block 454). Regardless, processing block 455 then increments the index variable and calculates the next point on the line. This calculation is done by adding the slope of the line, m, to the line's current value $L_K$. The slope need not be multiplied by the time difference between measured torque values since this is assumed to be 1. Decision block 456 then tests to see if the right endpoint of the line has been reached, i.e., the time at which peak torque was determined to have occurred. If this is not the case, control is passed back to processing block 452 for another iteration of the loop. If it is the case, $D_{max}$ is taken as the maximum difference value and $t_{max}$ as the time at which it occurs.

Program 400 next enters subroutine 460 which determines and displays the breakaway torque $T_B$. Decision block 461 tests to determine whether the maximum difference value $D_{max}$ is greater than a predetermined sensitivity value, S. If it is, then the breakaway torque $T_B$, is set to the torque measured at the time interval at which $D_{max}$ was found (processing block 463). If it is not, the breakaway torque is set to the value of the peak torque (processing block 452). Processing block 464 then displays the breakaway torque, via display 350. The program is then ended via end bock 470.

FIG. 5 illustrates the construction of a hand-held apparatus which may be employed to embody the present invention. Hand-held apparatus 10 includes a turning portion 26 which fits over the threaded fasteners 28 in order to tighten them. A shaft 24 connects the head 26 to a body portion 14 and a handle 12. The handle 12 is employed manually in order to provide the torque to the threaded fastener 28. The circuitry such as illustrated in FIG. 3 is contained within body portion 14. FIG. 5 illustrates display 350 and keyboard 370. Display 350 is visible from the exterior of housing 14. In addition, keyboard 370 is accessible from the outside of housing 14.

In using the apparatus 10 illustrated in FIG. 5, the user places the head 26 over the threaded fastener 28 to be tightened. Manual pressure is applied to develop the required torque via handle 12. Housing 14 includes the torque sensor 310 and other portions of the apparatus illustrated in FIG. 3 for production of the display of the previously applied torque. Typically, the user would exert force on the handle 12 until he feels a slight turning of the threaded fastener 28, indicating that breakaway has occurred. Thereafter, the previously applied torque will be displayed via display 350.

As described below, the apparatus 10 illustrated in FIG. 5 could be employed with an alternative embodiment of the program. In this case, alarm 360 is employed to alert the user that the breakaway point has been detected, and therefore he should cease pulling on handle 12.

Figure 6A:
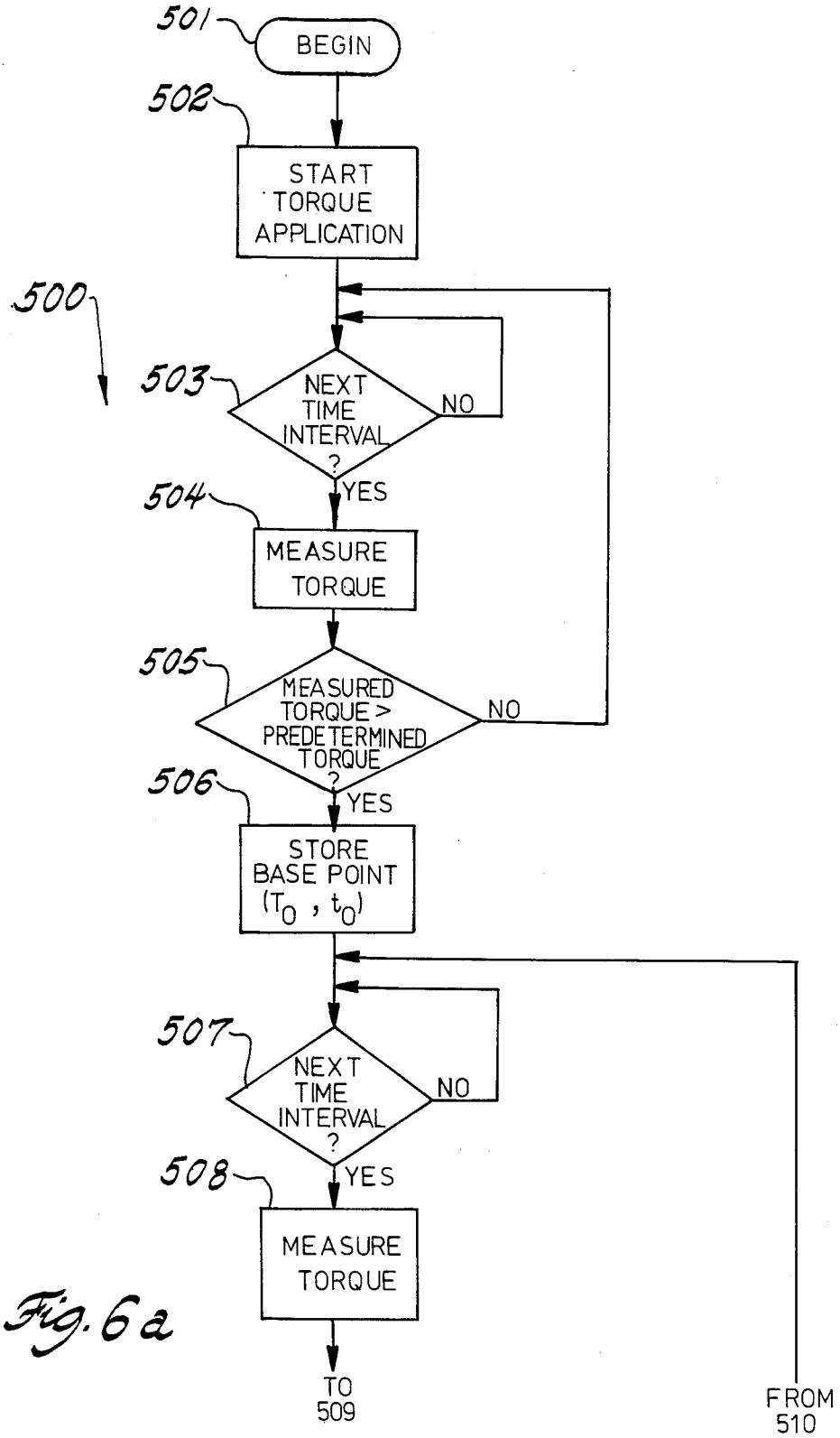
FIGS. 6*a* and 6*b* are a flow chart illustrating the measurement and calculation steps in accordance with an alternative embodiment of the present application.
Figure 6B:
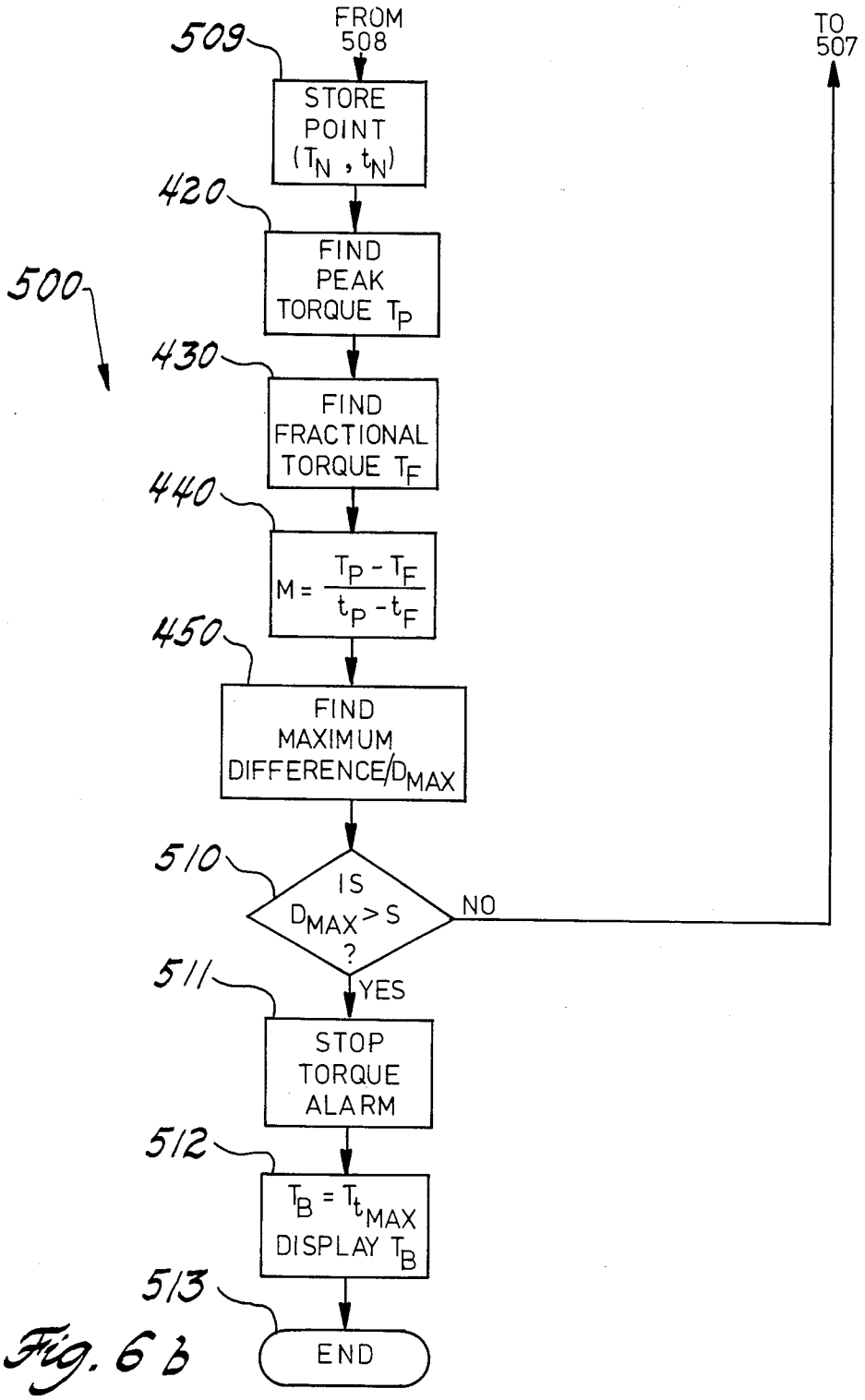

FIGS. 6*a* and 6*b* illustrate program 500 which shows the steps in performing the algorithm of an alternative embodiment to the present invention. Program 500 illustrated in FIGS. 6*a* and 6*b* provides a repetitive rending calculation of the maximum difference value and generates an alarm to stop the application of torque to the threaded fastener when the maximum difference value exceeds the predetermined value.

Program 500 is begun at start block 501. Program 500 initially corresponds to the beginning of program 400 illustrated in FIG. 4. Application of the torque to the threaded fastener is begun at processing block 502. Decision block 503 determines whether or not the next time interval has been reached. If this time interval has not been reached then this decision is repeated until it is reached. Once the next time interval has been reached then the torque is measured (processing block 504). As before this measurement takes place via torque sensor 310. Program 500 then tests whether the measured torque is greater than the predetermined torque for storage of the measured torque (decision block 505). If this is not the case then program 500 returns to decision block 503 to await the next time interval. If this is the case then the base point just measured is stored (processing block 506). Program 500 next tests to determine whether or not the next time interval has been reached (decision block 507). If this is the case then the torque is measured (processing block 508) and this last measured point is stored (processing block 509) in ram 333 as before.

In the event that the next time interval has not been reached then program 500 calculates whether or not the break point has been reached. This calculation corresponds generally to that previously illustrated in FIGS. 4*a* to 4*d* and employs many of the same subroutines. Firstly, the peak torque $T_p$ is found via subroutine 420. Next the fractional torque $T_f$ is found via subroutine 430. The slope is calculated via subroutine 440 in the same manner as previously illustrated in FIGS. 4*a* to 4*d*. Lastly, the maximum difference value $D_{max}$ is found in accordance with subroutine 450. Subroutines 420, 430 440 and 450 are as previously illustrated in FIGS. 4*a* to 4*d*.

Program 500 next tests to determine whether this computed maximum difference value $D_{max}$ is greater than the predetermined value (decision block 510). If this is not the case then control returns to decision block 507 to await the passing of the next time interval.

If on the other hand, the computed maximum difference value $D_{max}$ is greater than the predetermined value, then breakaway has occurred. Program 500 then generates a stop torque alarm (decision block 511). In the case of a hand-held device such as illustrated in FIG. 5, this alarm could be generated by alarm 360 connected to central processing unit 330. In this case, the alarm could be of the same type as employed for alarms in digital watches, that is an audible alarm. As will be explained below in conjunction with FIG. 7, this could be a control signal to stop the application of torque to the threaded fastener. In either case, the breakaway torque $D_B$ is set equal to the torque at the time of the maximum difference value $T_{tmax}$ and this breakaway torque $T_B$ is displayed as the previously applied torque (processing block 512). At this point program 500 is complete (end block 513).

Figure 7:
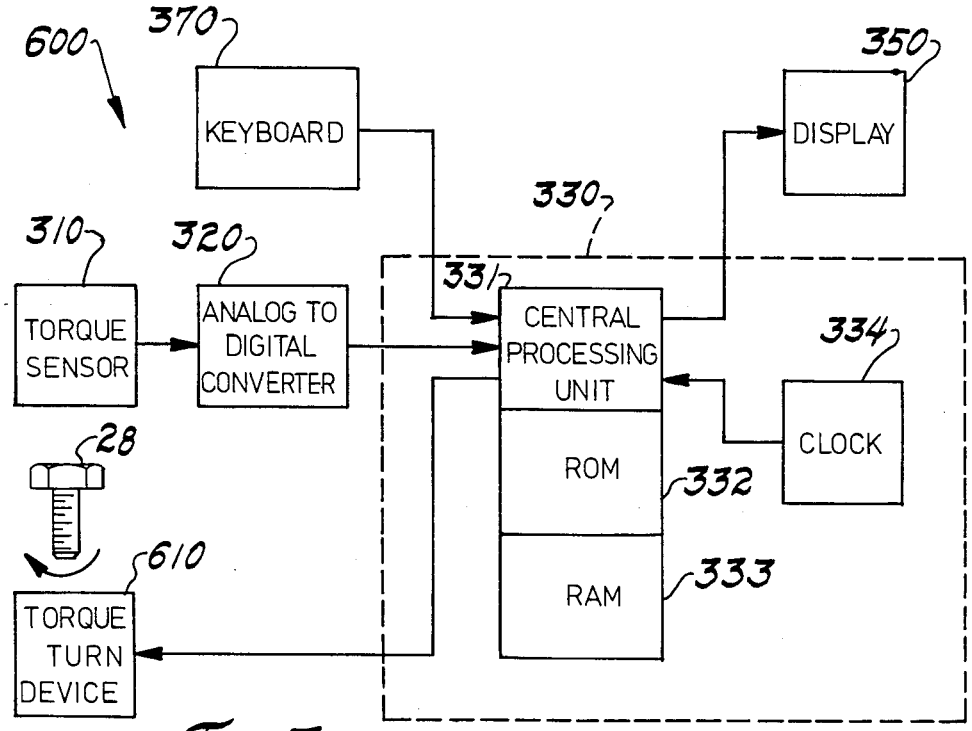
FIG. 7 is a block diagram of the electronic circuitry according to the alternative embodiment of the present invention.

FIG. 7 illustrates an alternative construction 600 in which the apparatus controls a torque turn device for automatic application of torque to the threaded fastener. Apparatus 600 corresponds generally to apparatus 300 illustrated in FIG. 3. However, apparatus 600 includes torque/turn device 610 for controlled automatic application of torque to threaded fastener 28. This torque is measured via torque sensor 310 in the manner previously described. Upon reaching the point at which the stop torque alarm is issued (processing block 511 of program 500) central processing unit 331 deactivates torque turn device 610 to cease applying torque to the threaded fastener. In other ways the apparatus 600 illustrated in FIG. 7 operates as previously described.

What is claimed is:

1. A method of determining the torque previously applied to a threaded fastener comprising the steps of:

applying additional torque to the threaded fastener in the tightening direction is gradually increasing magnitude until a slight rotation of the threaded fastener in the tightening direction is detected;

measuring the applied torque at repetitive predetermined time intervals;

storing the measured torque at the repetitive time intervals;

determining the stored peak torque;

determining the time interval of the stored fractional torque which first exceeds a predetermined fraction of the stored peak torque;

calculating the difference value between the stored torque and the calculated torque of a line segment joining the stored fractional torque and the stored peak torque for each repetitive time interval between the time interval of said stored fractional torque and the time interval of said stored peak torque;

determining the time interval having the greatest calculated difference value; and indicating the stored torque corresponding to the time interval of the greatest calculated difference value as the previously applied torque.

2. The method of claim 1, wherein said predetermined fraction of the stored peak torque is forty percent.

3. The method of claim 1, further comprising the steps of:

determining whether the greatest calculated difference value is greater than a predetermined value; and indicating the stored peak torque as the previously applied torque if the greatest calculated difference value is not greater than said predetermined value.

4. An apparatus for determining the torque previously applied to a threaded fastener comprising:

means for applying a gradually increasing torque to the threaded fastener in the tightening direction;

torque measuring means for measuring the torque applied to the threaded fastener;

clock means for generating an indication of repetitive predetermined time intervals;

memory means connected to said torque measuring means and said clock means for storing said measured torque for each repetitive time interval;

means for ceasing application of torque to the threaded fastener when a slight rotation of the threaded fastener in the tightening direction occurs;

means connected to said memory means for determining the stored peak torque;

means connected to said memory means for determining the time interval of the stored fractional torque which first exceeds a predetermined fraction of said stored peak torque;

means for calculating the difference value between said stored torque and the calculated torque of a line segment joining said stored fractional torque and said stored peak torque for each repetitive time interval between said time interval of said stored fractional torque and the time interval of said stored peak torque;

means for determining the time interval of the greatest calculated difference value;

means for generating a display signal corresponding to said torque stored in said memory for the time interval of said greatest difference value; and display means for generating a visually perceivable indication of said display signal.

5. The apparatus for determining the torque previously applied to a threaded fastener as claimed in claim 4, wherein:

said means for applying a gradually increasing torque to the threaded fastener consists of a manually operable lever for use by an operator; and said means for ceasing application of torque to the threaded fastener includes release of said manually operable lever when the operator detects slight rotation of the threaded fastener.

6. The apparatus for determining the torque previously applied to a threaded fastener as claim in claim 4, wherein said predetermined fraction of said stored peak torque is forty percent.

7. The apparatus for determining the torque previously applied to a threaded fastener as claimed in claim 4, further including:

means for determining whether said greatest calculated difference value is greater than a predetermined value; and wherein said means for generating a display signal generates said display signal corresponding to said torque stored in said memory for the time interval of said greatest difference value if said greatest calculated difference value is greater than said predetermined value and corresponding to said stored peak torque if said greatest calculated difference value is not greater than said predetermined value.

8. The apparatus for determining the torque previously applied to a threaded fastener as claimed in claim 4, further comprising:

means connected to said torque measuring means and said memory means for storing said measured torque in said memory means only when said measured torque is greater than a predetermined torque.

9. An apparatus for determining the torque previously applied to a threaded fastener comprising:

means for applying a gradually increasing torque to the threaded fastener in the tightening direction;

torque measuring means for measuring the torque applied to the threaded fastener;

clock means for generating an indication of repetitive predetermined time intervals;

memory means connected to said torque measuring means and said clock means for storing said measured torque for each repetitive time interval;

means connected to said memory means for determining the stored peak torque;

means connected to said memory means for determining the time interval of the stored fractional torque which first exceeds a predetermined fraction of said stored peak torque;

means for calculating the difference value between said stored torque and the calculated torque of a line segment joining said stored fractional torque and said stored peak torque for each repetitive time interval between the time interval of said stored fractional torque and the time interval of said stored peak torque;

means for determining the time interval of the greatest calculated difference value;

control means for ceasing application of torque to said threaded fastener if said greatest calculated difference value is greater than a predetermined value;

display means for generating a visually perceivable indication of the stored torque at the time interval of said greatest calculated difference value if said greatest calculated difference value is greater than said predetermined value.

10. The apparatus for determining the torque previously applied to a threaded fastener as claimed in claim 9 wherein:

said means for applying a gradually increasing torque to the threaded fastener consists of a manually operable lever for use by an operator; and said control means generates an operator perceivable alarm if said greatest calculated difference value is greater than said predetermined value, thereby alerting the operator to release said lever.

11. The apparatus for determining the torque previously applied to a threaded fastener as claimed in claim 10, wherein said alarm is an audible alarm.

12. The apparatus for determining the torque previously applied to a threaded fastener as claimed in claim 9, wherein:

said means for applying a gradually increasing torque to the threaded fastener consists of a torque application apparatus connected to and controlled by said control means; and said control means generates control signals for control of said means for applying a gradually increasing torque to said threaded fastener including ceasing application of torque if said greatest calculated difference is greater than said predetermined value.

* * * * *